US007752812B2

(12) United States Patent
Knudson et al.

(10) Patent No.: US 7,752,812 B2
(45) **Date of Patent: *Jul. 13, 2010**

(54) INTEGRATED DEBRIS-SHIELDING COVER, FLASHING & MOUNTING SYSTEM FOR RAIN GUTTER

(76) Inventors: Gary A. Knudson, 15427C W. 66th Dr., Arvada, CO (US) 80007; Patrick D. Flood, 15857 W. 74th Pl., Arvada, CO (US) 80007

( * ) Notice: Subject to any disclaimer, the term of this patent is extended or adjusted under 35 U.S.C. 154(b) by 1 day.

This patent is subject to a terminal disclaimer.

(21) Appl. No.: 12/474,452

(22) Filed: May 29, 2009

(65) Prior Publication Data

US 2009/0235592 A1 Sep. 24, 2009

Related U.S. Application Data

(63) Continuation of application No. 11/944,759, filed on Nov. 26, 2007, now Pat. No. 7,730,672.

(51) Int. Cl.
*E04D 13/00* (2006.01)

(52) U.S. Cl. ..... 52/12; 248/48.1; 248/48.2

(58) Field of Classification Search ..... 52/11, 52/12, 14; 248/48.1, 48.2
See application file for complete search history.

(56) References Cited

U.S. PATENT DOCUMENTS

| | | | | |
|---|---|---|---|---|
| 836,012 | A | 11/1906 | Cassen | |
| 3,752,428 | A | 8/1973 | Trostle | |
| 4,000,587 | A | 1/1977 | Weber | |
| 4,241,548 | A | 12/1980 | Rowe | |
| 4,497,146 | A | 2/1985 | Demartini | |
| 4,727,689 | A * | 3/1988 | Bosler | 52/12 |
| 4,757,649 | A | 7/1988 | Vahldieck | |
| 4,796,390 | A | 1/1989 | Demartini | |
| 4,876,827 | A | 10/1989 | Williams | |
| 4,937,986 | A | 7/1990 | Way | |
| 5,040,750 | A | 8/1991 | Brandt | |
| 5,189,849 | A | 3/1993 | Collins | |
| 5,251,410 | A | 10/1993 | Carey | |
| 5,305,562 | A | 4/1994 | Sapia | |
| 5,388,377 | A | 2/1995 | Faulkner | |
| 5,406,755 | A | 4/1995 | Serano | |
| 5,457,916 | A | 10/1995 | Tenute | |
| 5,459,965 | A | 10/1995 | Meckstroth | |
| 5,495,694 | A | 3/1996 | Kuhns | |
| 5,592,783 | A | 1/1997 | Jones | |
| 5,595,027 | A | 1/1997 | Vail | |
| 5,617,678 | A | 4/1997 | Morandin | |
| 5,640,809 | A | 6/1997 | Iannelli | |

(Continued)

*Primary Examiner*—Richard E Chilcot, Jr.
*Assistant Examiner*—Theodore Adamos
(74) *Attorney, Agent, or Firm*—Ancel W. Lewis, Jr.

(57) ABSTRACT

A rain gutter system includes fastening clips, fasteners, a rain gutter and a reverse-curve shield. The shield includes a back dam that overlaps existing flashing and has a crease at the bottom. The fastening clips have a groove that locates the fastening clips relative to the back dam. The upper back end of the back wall of the rain gutter forms a snap together joint with lower end of the back dam. The rain gutter is anchored to the back dam and fastening clips vertically and in the fore/aft direction, and can slide laterally. The front upper end of the rain gutter slopes up and back to improve debris shedding.

11 Claims, 5 Drawing Sheets

U.S. PATENT DOCUMENTS 5,640,810 A 6/1997 Pietersen
5,737,879 A 4/1998 Sweet
5,740,633 A * 4/1998 Champagne ..... 52/11
5,845,435 A * 12/1998 Knudson ..... 52/11
5,862,631 A * 1/1999 Attaway et al. ..... 52/11
5,960,591 A * 10/1999 Schluter ..... 52/11
6,016,631 A 1/2000 Lowrie
6,073,398 A 6/2000 Williams
6,098,344 A 8/2000 Albracht
6,098,345 A 8/2000 Demartini
6,269,592 B1 8/2001 Rutter
6,412,228 B1 7/2002 Meckstroth
6,463,700 B2 10/2002 Davis
6,493,993 B1 12/2002 Serano
6,536,165 B2 3/2003 Pilcher
6,594,956 B1 7/2003 Willing
6,658,796 B1 12/2003 Higgins
6,672,012 B2 1/2004 Bahroos et al.
6,681,527 B2 1/2004 Baker
6,688,045 B1 2/2004 Pilcher
6,701,674 B1 3/2004 Albracht
6,732,477 B1 5/2004 Richard
6,735,907 B2 5/2004 Stevens
6,745,517 B2 6/2004 Vahldieck
6,823,630 B2 11/2004 Marra
6,826,872 B2 12/2004 Brochu
6,904,718 B2 6/2005 Fox
6,944,991 B2 9/2005 Kim
6,944,992 B2 9/2005 Brochu
6,968,651 B2 11/2005 Bergeron
6,993,870 B2 2/2006 McDonald et al.
6,993,871 B2 2/2006 Richard et al.
7,082,723 B2 8/2006 Gramling
7,104,011 B1 9/2006 Knight
7,104,012 B1 9/2006 Bayram
7,117,643 B2 10/2006 Brown
7,257,933 B2 8/2007 Walters
2004/0000098 A1* 1/2004 Knudson ..... 52/12
2004/0040219 A1 3/2004 Bacik et al.
2004/0244304 A1 12/2004 Bullinger
2005/0000167 A1 1/2005 Richard et al.
2005/0115158 A1 6/2005 Brown
2005/0166465 A1* 8/2005 Banks et al. ..... 52/11
2005/0172565 A1 8/2005 Riley et al.
2006/0053696 A1* 3/2006 Gramling ..... 52/11
2007/0119104 A1 5/2007 Pijanowski
2007/0130842 A1 6/2007 Walters
2007/0169423 A1* 7/2007 Brochu ..... 52/12

* cited by examiner

INTEGRATED DEBRIS-SHIELDING COVER, FLASHING & MOUNTING SYSTEM FOR RAIN GUTTER

This application is a continuation-in-part of Ser. No. 11/944,759 filed Nov. 26, 2007, which claims the benefit under 35 U.S.C. §119(e) of the U.S. provisional patent application No. 60/867,649 filed Nov. 29, 2006.

TECHNICAL FIELD

The present invention relates to rain gutters for buildings and more particularly to an integrated rain gutter, reverse-curve shield, back flashing or back dam, and fastening clip system.

BACKGROUND ART

Open trough rain gutters collect debris that falls on the roof and washes down with the rain water. Systems to shield the rain gutter from debris include screens over the open trough and reverse-curve shields. The screens have a tendency to clog with small debris, blocking the rain water from entering the rain gutter.

Reverse-curve shields or hoods generally have a sloped planar section that extends over the rain gutter and a coextensive curved section that first curves forwardly and downwardly over the front of the rain gutter and then curves downwardly and inwardly. Rain water, through liquid adhesion principles, follows the curved section to the lower edge of the shield and falls from this lower edge into the rain gutter. Debris washed down by the rain water falls off at the forward extent of the curved section of the shield and drops to the ground.

Known reverse-curve shields can generally be divided into two types. In a first type, the rear of the shield is integrated into the roof, typically by sliding the rear edge of the shield under the lower, forward edge of the roof covering. Reverse-curve shields typically require a certain amount of vertical spacing above the rain gutter. Open top rain gutters are generally mounted as high as possible on the eave, adjacent to the lower edge of the roof. When a reverse-curve shield is added over an open top rain gutter, the required vertical spacing of the shield above the rain gutter can result in the rear edge of the shield being higher than the roof edge. In order to achieve an appropriate geometric configuration of the shield relative to the rain gutter for correct functionality, this first type of reverse-curve shield is typically used when a reverse-curve shield is added over an existing open top rain gutter.

In the second type of reverse-curve shield, the shield mounts only over the rain gutter, independent of the roof. This second type of reverse-curve shield is mounted with specialized fastening clips and typically mounted with the rain gutter as part of an integrated system. When positioned correctly, the shield is located slightly below the roof edge and completely above both the front edge and back edge of the rain gutter. This type of positioning often leaves the back edge of the gutter located well below the existing flashing with the fascia behind the gutter exposed and susceptible to leakage behind the gutter.

Seams or joints in a rain gutter can leak. Seamless rain gutters, with a single seamless section of rain gutter along each straight section of guttered eave, reduce the possibility of leakage and are preferable over rain gutters with joints or seams along straight sections of rain gutter. In many known rain gutters, including many seamless rain gutters, the fasteners that attach the rain gutter to the eave, pierce the rain gutter.

Differential thermal expansion between the rain gutter and eave can generate stress on these fasteners, creating a possibility of failure. A mounting system for a rain gutter that allows the rain gutter and shield to independently expand relative to the eave is desirable.

DISCLOSURE OF THE INVENTION

An integrated covered rain gutter system includes a back-flashing, a plurality of fastening clips, a fastener for each fastening clip, an open-top rain gutter, and a reverse-curve shield. The fasteners extend through the base of the fastening clips and the back flashing to anchor the fastening clips and the back flashing to the fascia. The rain gutter and the shield are each mounted on the back flashing and/or the fastening clips, each being anchored vertically and in a fore/aft direction while being allowed to float laterally to prevent stress from thermal expansion. The upper back end of the rain gutter extends behind the lower edge of the back flashing. The upper front end of the rain gutter has an angled face to improve debris shedding. One end of the shield has a barb that is received into a shaped receiving slot on the fastening clips to semi-permanently attach the shield. Means are provided for uniformly locating or aligning the fastening clips relative to the shield.

An alternative integrated covered rain gutter system includes, an open-top rain gutter, a plurality of fastening clips, a fastener for each fastening clip, and a reverse-curve shield with an integrated back dam. The fasteners extend through the base of the fastening clips and the shield to anchor the fastening clips and the shield to the fascia. The rain gutter is mounted on the fastening clips, being anchored vertically and in a fore/aft direction while being allowed to float laterally to prevent stress from thermal expansion. The upper back end of the rain gutter connects to the lower back edge of the shield with a snap together joint. The upper front end of the rain gutter has an angled face to improve debris shedding. The front end of the shield has a barb that is received into a shaped receiving slot on the fastening clips to semi-permanently attach the shield. Means are provided for uniformly locating or aligning the fastening clips relative to the gutter and the shield. The back dam prevents leakage behind the rain gutter.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
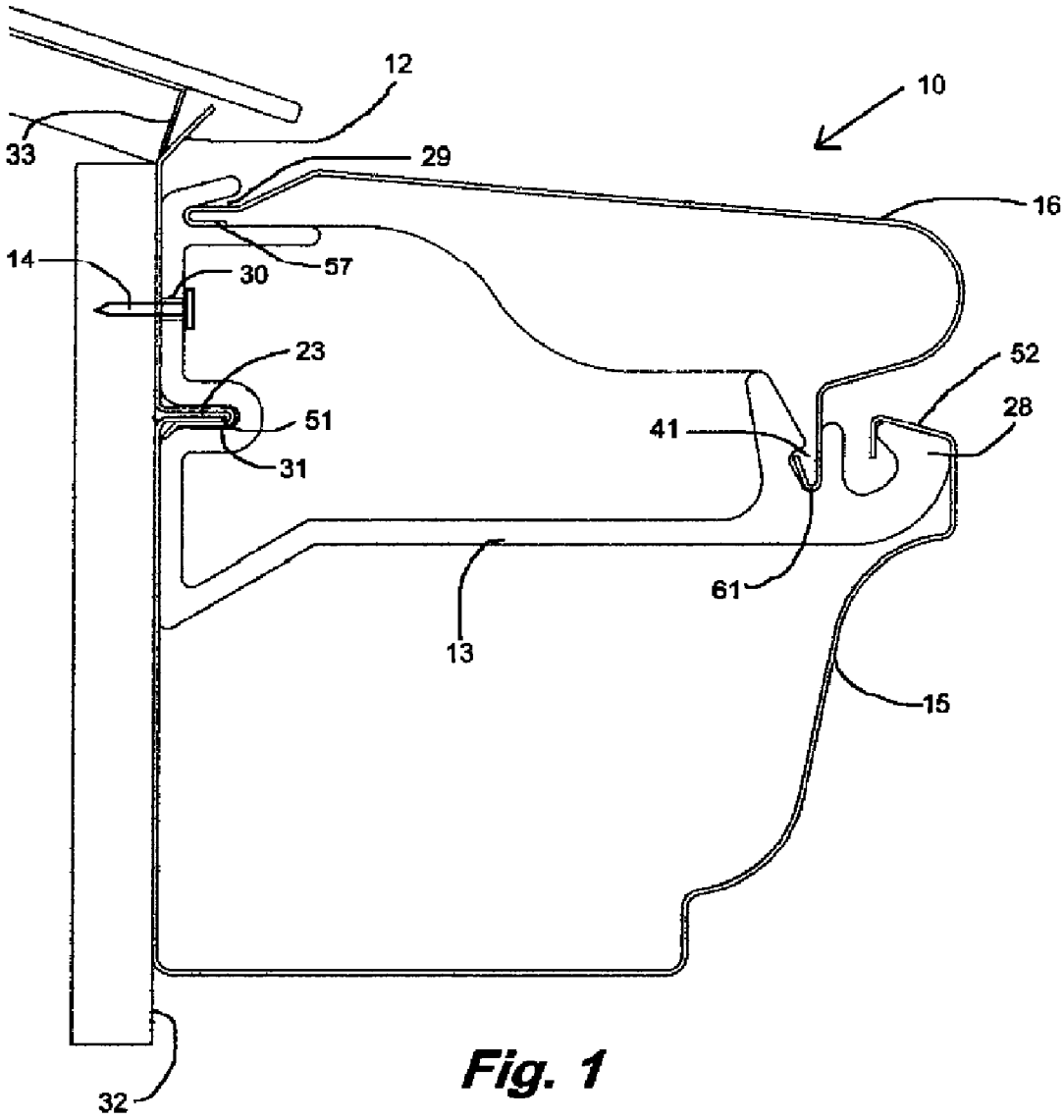
FIG. 1 is a side plan view of a covered rain gutter system embodying features of the present invention.
Figure 2:
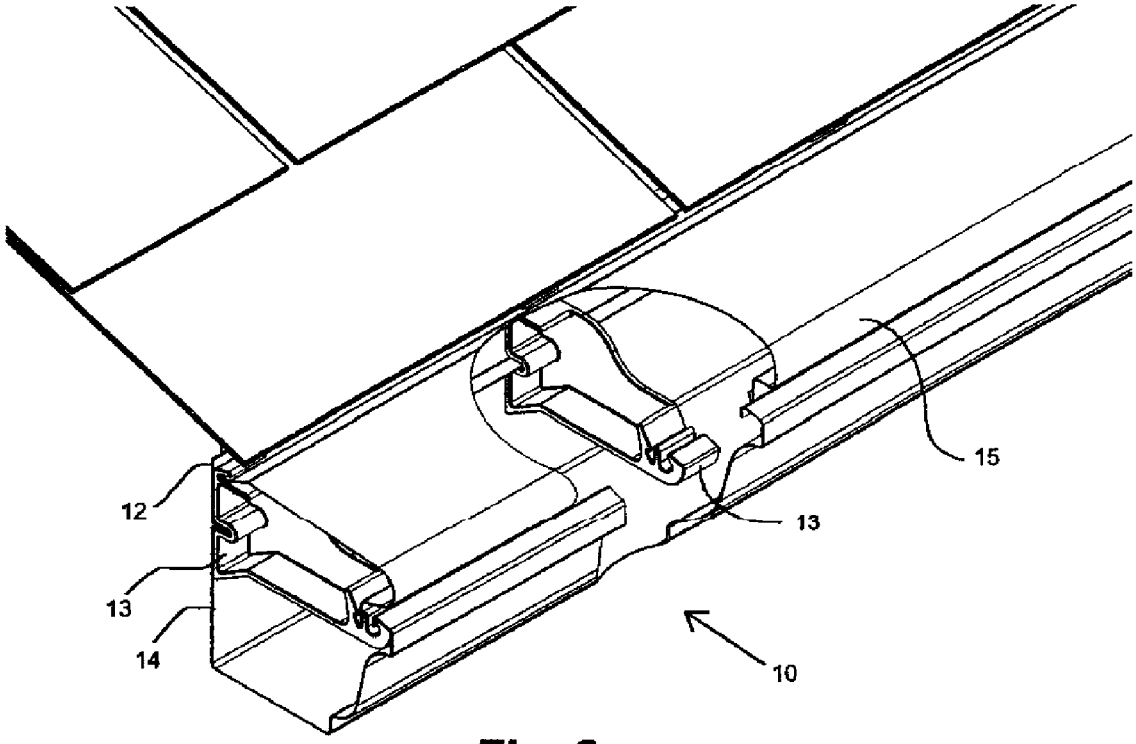
FIG. 2 is a perspective, partially cut-away view of the system of FIG. 1.

Referring now to FIGS. 1 and 2, an integrated covered rain gutter system 10 embodying features of the present invention includes a back-flashing 12, a plurality of fastening clips 13, fastener 14 for each fastening clip 13, an open-top rain gutter 15, and a reverse-curve shield 16. The back flashing 12, rain gutter 15 and reverse-curve shield 16 are preferably each roll formed from sheet metal. The back flashing 12, rain gutter 15 and reverse-curve shield 16 could also be plastic and could be molded or extruded. The advantage to roll forming is that the length of each back flashing 12, rain gutter 15 and reverse-curve shield 16 can be tailored to the length of each eave, so that a substantially seamless rain gutter system 10 can be provided.

Describing the specific embodiments herein chosen for illustrating the invention, certain terminology is used which will be recognized as being employed for convenience and having no limiting significance. For example, the terms "front" and "forward" will refer to directions away from the fascia or eave and "back" or "rearward" will refer to directions toward from the fascia or eave on which the rain gutter is installed. With reference to the drawings, this means that "forwardly" is to the right and "rearwardly" is to the left. Further, all of the terminology above-defined includes derivatives of the word specifically mentioned and words of similar import.

Figure 3:
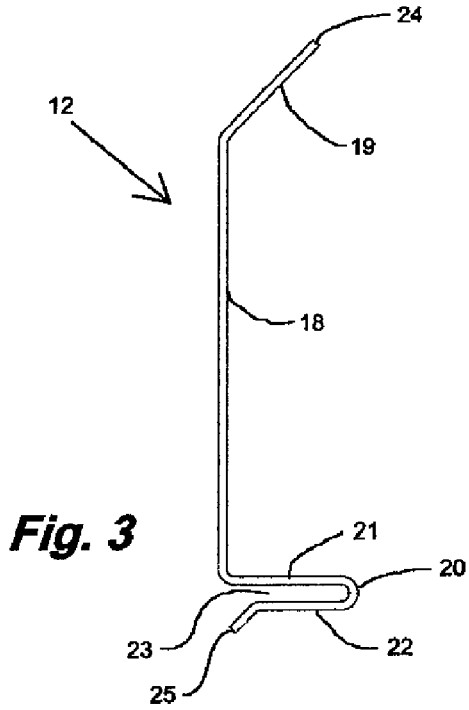
FIG. 3 is a side plan view of the back flashing of FIG. 1.

The back flashing 12, as shown in FIG. 3, has a substantially vertical, planar intermediate portion 18, a generally planar upper portion 19 that extends upwardly and forwardly from the top of the intermediate portion 18 to an upper edge 24, and a crease 20 that projects forwardly from the bottom of the intermediate portion 18. The crease 20 is formed with a forwardly projecting first fold 21 from the bottom of the intermediate portion 18 connected to a spaced, generally parallel, second fold 22 that projects rearwardly below the first fold 21 to a lower edge 25, with a rearwardly opening slot 23 being formed between the first and second folds 21 and 22.

Figure 4:
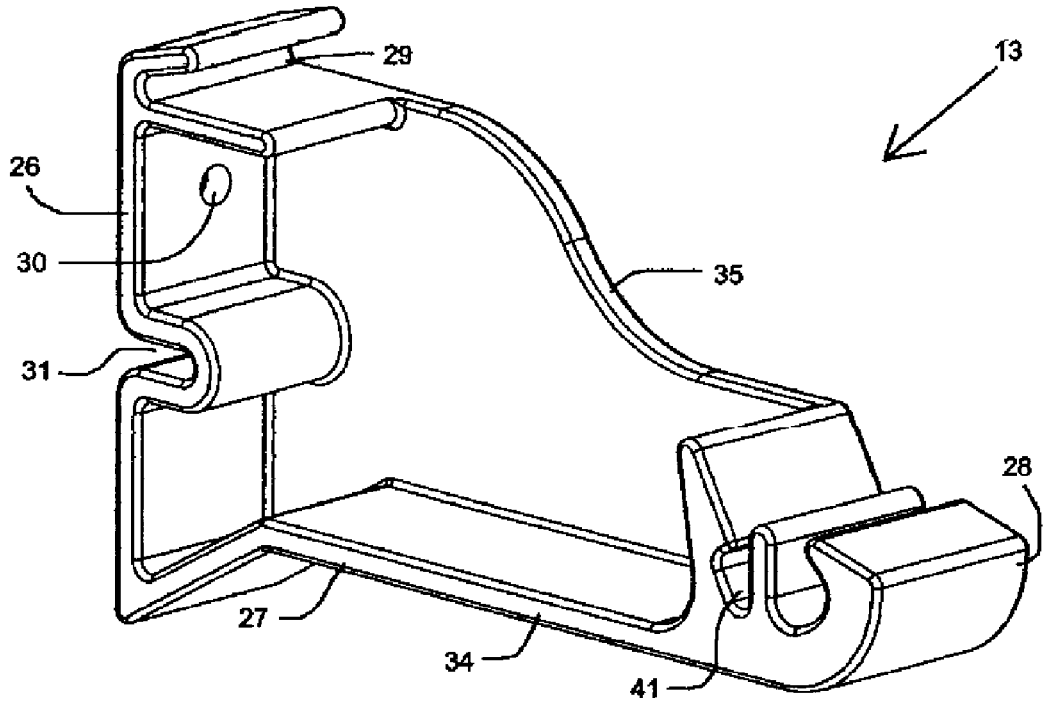
FIG. 4 is a perspective view of the fastening clip of FIG. 1.
Figure 5:
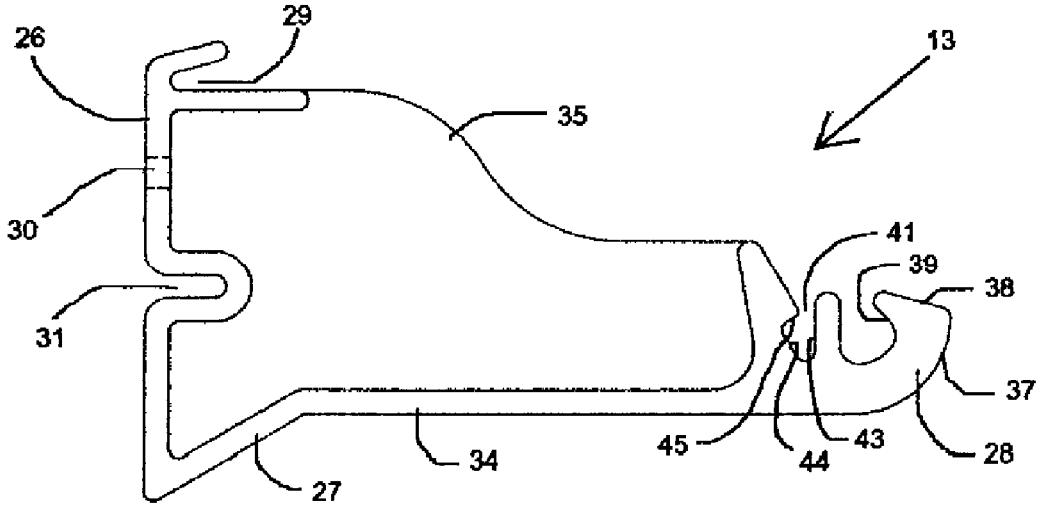
FIG. 5 is a side plan view of the fastening clip of FIG. 1.

Referring to FIGS. 4 and 5, the fastening clip 13 has a base 26 and a support body 27 that extends forwardly from the base 26 to a forward end 28. The fastening clip 13 can be molded plastic. The base 26 is generally vertical, and has a forwardly opening first receiving slot 29 at the top of the base 26, a fastener aperture 30 below the first receiving slot 29, and a rearwardly opening groove 31 below the fastener aperture 30.

As shown in FIG. 1, the groove 31 is sized and shaped to receive the crease 20 of the back flashing 12, and in cooperation with the crease 20 of the back flashing 12, provides a means for aligning the fastening clips 13 with the back flashing 12. The back flashing 12 is mounted to the fascia 32, with the fastening clips 13 spaced along the back flashing 12, by a fastener 14 that extends through the fastener aperture 30 in each fastening clip 13, through the back flashing 12 and into the fascia 32. The back flashing 12 preferably overlaps the existing flashing 33. The upper portion 19 of the back flashing 12 extends above the top of the base 26 of each fastening clip 13 to protect the fascia 32 above the top of the base 26.

Referring again to FIGS. 4 and 5, the support body 27 of the fastening clips 13 has a lower portion 34 and a web portion 35. The lower portion 34 extends upwardly and forwardly from the bottom of the base 26 and then horizontally forwardly to the forward end 28. The forward end 28 has a lower surface 37 that curves upwardly and forwardly, and an upper surface 38 that slopes upwardly and rearwardly from the front of the lower surface 37. A rearward surface 39 of the forward end 28 curves, from the back of the upper surface, downwardly, then downwardly and forwardly and then downwardly and rearwardly.

The lower portion 34 of the support body 27 has an upwardly opening second receiving slot 41 spaced rearwardly from the rearward surface 39 of the forward end. The second receiving slot 41 has a generally barb shape with a substantially vertical forward surface 43, a lower rearward surface 44 that slants upwardly and rearwardly and an upper rearward surface 45 that slants upwardly and forwardly so that the second receiving slot 41 tapers at the top. The web portion 35 is a vertical wall that extends upwardly from the lower portion 34 to the first receiving slot 29 and forwardly from the base 26 to the second receiving slot 41.

Figure 6:
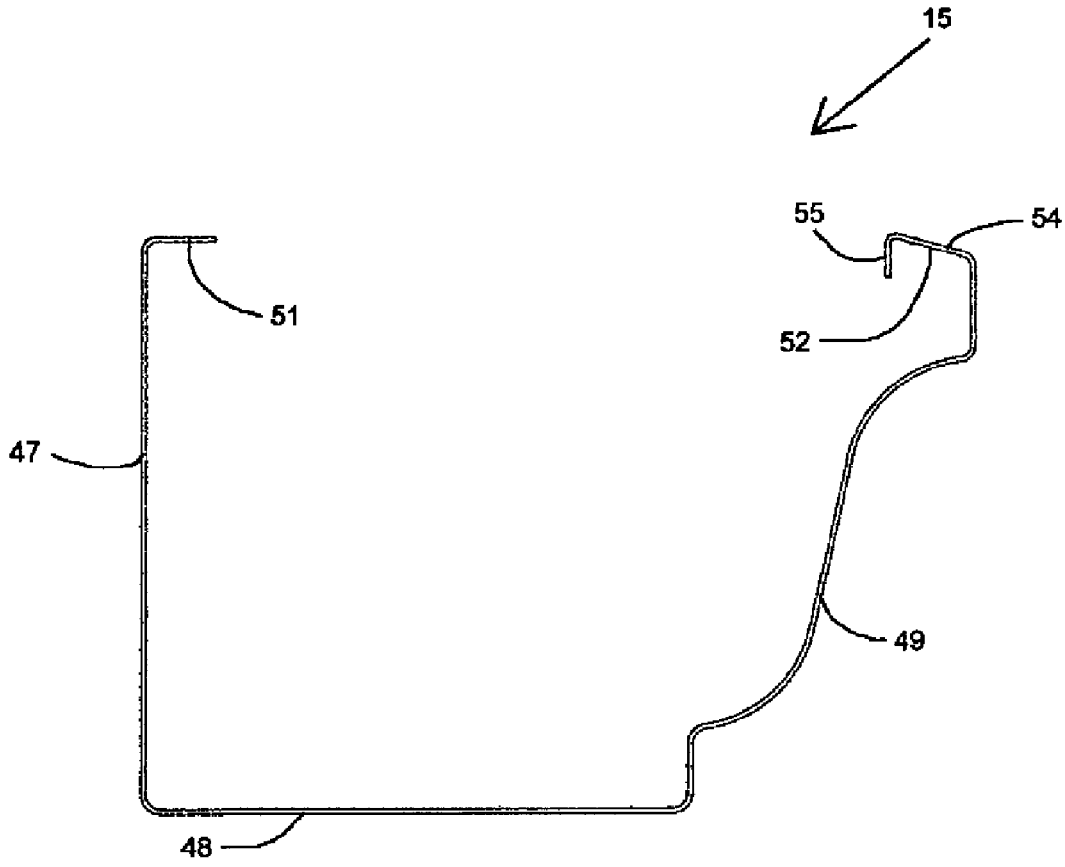
FIG. 6 is a side plan view of the rain gutter of FIG. 1.

As shown in FIG. 6, the rain gutter 15 has an open top trough shape and includes a back wall 47, a bottom wall 48 and a front wall 49. The back wall 47 is generally planar and vertical. The bottom wall 48 projects forwardly from the bottom of the back wall 47, and is generally planar and horizontal. The front wall 49 projects upwardly and forwardly from the bottom wall 48, and is shaped. The front wall 49 shape is first vertical, then transitions into a forwardly convex curve, then transitions into a forwardly concave curve, and then transitions to vertical again.

The upper back end 51 of the rain gutter 15 is formed by a forwardly projecting right angle bend at the top of the back wall 47. The upper front end 52 of the rain gutter 15 has a front portion 54 that angles rearwardly and upwardly from the top of the front wall 49, and a rear portion 55 projects downwardly from the back of the front portion 54. As shown in FIG. 1 the upper back end 51 fits into the slot 23 in the back flashing 12 and the upper front end 52 fits over the forward end 28 of the fastening clip 13, so that the rain gutter 15 is slidably mounted to and floats relative to the back flashing 12 and the fastening clip 13. The upper back end 51 fitting into the slot 23 places the upper back end 51 above and behind the bottom of the back flashing 12, preventing leakage between the bottom of the back flashing 12 and the top of the back wall 47 of the rain gutter 15. The angled front portion 54 of the upper front end 52 enhances debris shedding.

Figure 7:
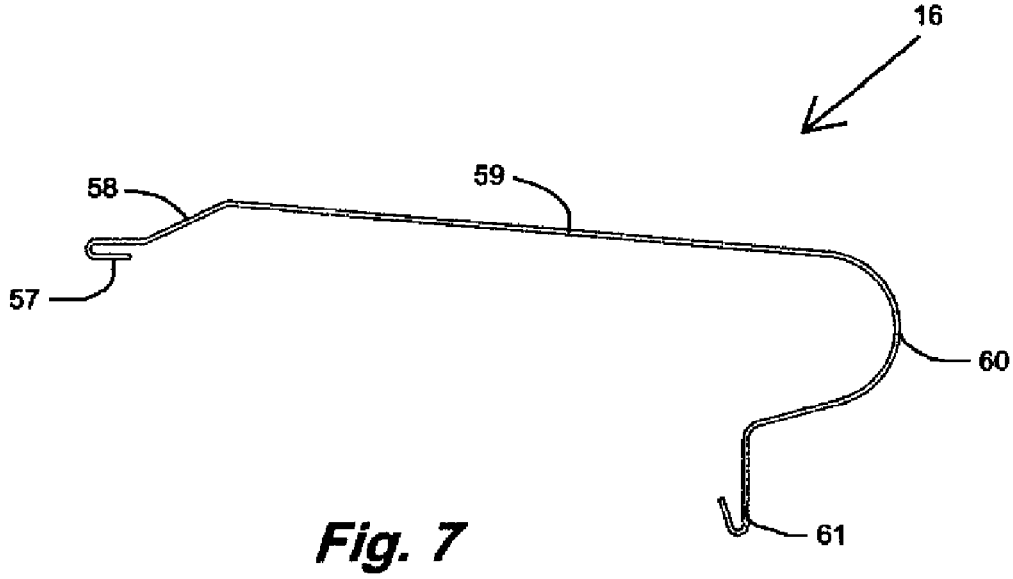
FIG. 7 is a side plan view of the shield of FIG. 1.

Referring to FIG. 7, the reverse-curve shield 16 includes a substantially horizontal first end 57, a substantially planar rearward section 58 that slopes forwardly and upwardly from the first end 57, a substantially planar intermediate section 59 that slopes forwardly and downwardly from the rearward section 58 and a reverse curve forward section 60 that extends forwardly from the rearward section 59 to a second end 61. The forward section 60 curves downwardly until the forward section 60 projects rearwardly. The first end 57 shown is a downward and forward 180 fold. The second end 61 has a barb shape, extending downwardly from the forward section 60 and then folding rearwardly to project upwardly and rearwardly at an angle.

As shown in FIG. 1, the first end 57 of the reverse-curve shield 16 fits into the first receiving slot 29 of the fastening clip 13. The second end 61 of the reverse-curve shield 16 fits into the second receiving slot 41 of the fastening clip 13. The first and second receiving slots 29 and 41 position the intermediate section 59 of the reverse-curve shield 16 at a selected angle and the front of forward section 60 the of the reverse-curve shield 16 at a selected alignment over the front of the rain gutter 16. The complementary barb shapes of the second end 61 of the reverse-curve shield 16 and the second receiving slot 41 of the fastening clip 13 allow the second end 61 of the reverse-curve shield 16 to snap into the second receiving slot 41 of the fastening clip 13, providing semi-permanent mounting of the reverse-curve shield 16 and preventing the wind from dislodging the reverse-curve shield 16. The reverse-curve shield 16 is slidably mounted to and floats relative to the fastening clips 13. The first and second receiving slots 29 and 41 are positioned, and the reverse-curve shield in shaped to place the intermediate section 59 at a selected angle with the forward section 60 at a selected alignment over the upper front end 52 of the rain gutter 15.

Figure 8:
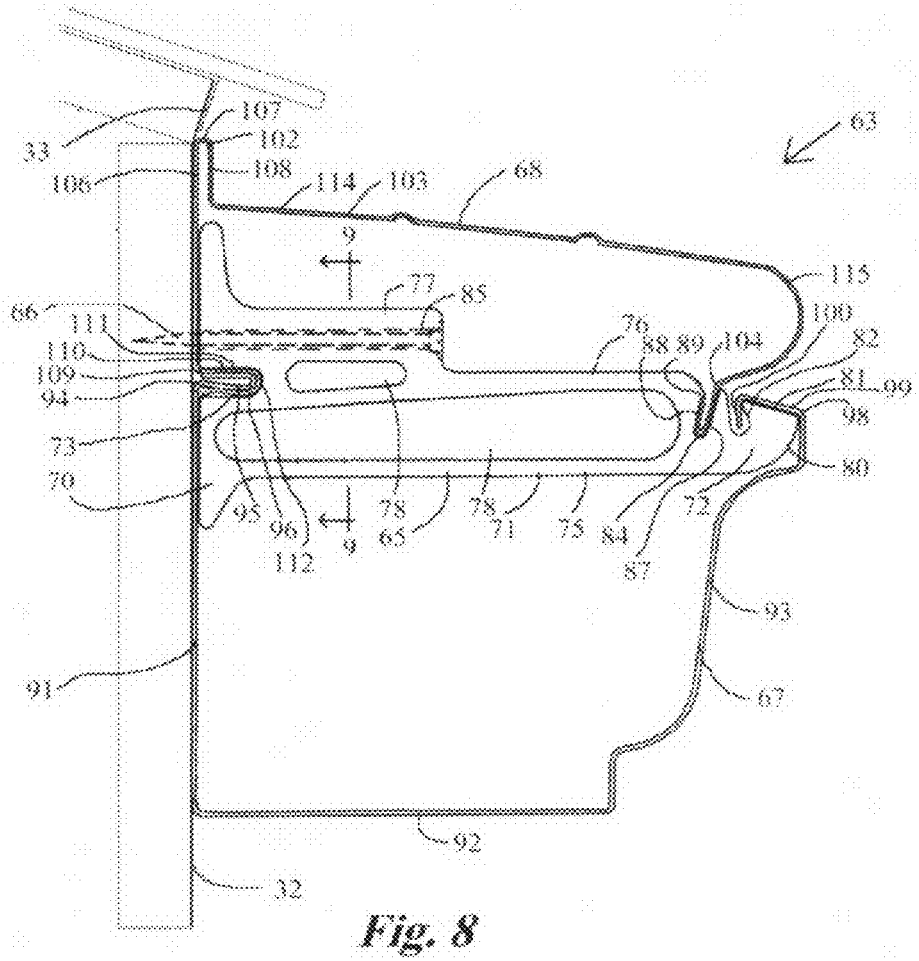
FIG. 8 is a side plan view of an alternative covered rain gutter system embodying features of the present invention.
Figure 9:
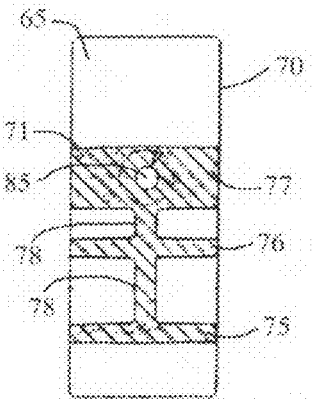
FIG. 9 is a sectional view of the fastening clip of the system of FIG. 8 taken along line 9-9.

Referring now to FIGS. 8 and 9, an alternative integrated covered rain gutter system 63 embodying features of the present invention includes a plurality of fastening clips 65, a fastener 66 for each fastening clip 65, an open-top rain gutter 67, and a reverse-curve shield 68. The rain gutter 67 and reverse-curve shield 68 are preferably each roll formed from sheet metal. The rain gutter 67 and reverse-curve shield 68 could also be plastic and could be molded or extruded. The advantage to roll forming is that the length of each rain gutter 67 and reverse-curve shield 68 can be tailored to the length of each eave, so that a substantially seamless rain gutter system 63 can be provided.

The fastening clip 65 has a base 70 and a support body 71 that extends forwardly from the base 70 to a forward end 72. The fastening clip 65 can be molded plastic. The base 70 is generally vertical and has a rearwardly opening groove 73. The support body 71 has spaced lower, intermediate and upper portions 75, 76 and 77 that project forwardly from the base 70, and web portions 78 that extend between the lower, intermediate and upper portions 75, 76 and 77. The lower portion 75 extends forwardly from the bottom of the base 70 to the forward end 72.

The lower and intermediate portions 75 and 76 converge a selected distance behind the forward end 72. The forward end 72 has a lower surface 80 that curves upwardly and forwardly, and an upper surface 81 that slopes upwardly and rearwardly from the front of the lower surface 80. A rearward surface 82 of the forward end 72 curves, from the back of the upper surface 81, downwardly, then downwardly and forwardly and then downwardly and rearwardly. The lower portion 75 has an upwardly opening receiving slot 84 between the rearward surface 82 and the convergence of the lower and intermediate portions 75 and 76. The intermediate and upper portions 76 and 77 converge intermediate the base 70 and the forward end 72. A fastener aperture 85 extends through the upper portion 76 and the base 70, above the groove 73. The receiving slot 84 has a generally barb shape with a substantially vertical forward surface 87, a lower rearward surface 88 that slants upwardly and rearwardly and an upper rearward surface 89 that slants upwardly and forwardly so that the receiving slot 84 tapers at the top.

The rain gutter 67 has an open top trough shape and includes a back wall 91, a bottom wall 92 and a front wall 93. The back wall 91 is generally planar and vertical. The bottom wall 92 projects forwardly from the bottom of the back wall 91, and is generally planar and horizontal. The front wall 93 projects upwardly and forwardly from the bottom wall 92, and is shaped. The front wall 93 shape shown is first vertical, then transitions into a forwardly convex curve, then transitions into a forwardly concave curve, and then transitions to vertical again. Rain gutters 67 of other shapes can be used.

The upper back end 94 of the rain gutter 67 is formed into a forwardly projecting first joint portion 95, shown as a rearwardly opening first crease 96. The upper front end 98 of the rain gutter 67 has a front portion 99 that angles rearwardly and upwardly from the top of the front wall 93, and a rear portion 100 that projects downwardly from the back of the front portion 99. The upper front end 98 fits over the forward end 72 of the fastening clip 65, so that the rain gutter 67 is slidably mounted to and floats relative to the fastening clip 65. The angled front portion 99 of the upper front end 98 enhances debris shedding.

The shield 68 includes a back dam 102 and a shield portion 103 that extends forwardly from the back dam 102 to a forward end 104. The back dam 102 has a front wall 106 that projects upwardly to a fold 107 and a spaced back wall 108 that extends downwardly from the fold 107. The back wall 108 extends downwardly beyond the bottom of the front wall 106 to a lower back end 109. The lower back end 109 is formed into a forwardly projecting second joint portion 110, shown as a rearwardly opening second crease 111.

The second crease 111 is sized and shaped to snap over the first crease 96 on the gutter 67 to form a snap together joint 112. The joint 112 is sized and shaped to fit into the groove 73 in the base 70 of each fastening clip 65. The joint 112, in combination with the groove 73, is a means for aligning the fastening clips 65 along the back dam 102 and the gutter 67.

The shield portion 103 of the shield 68 has a substantially planar rearward section 114 that slopes forwardly and downwardly from the bottom of the front wall 106 of the back dam 102 and a reverse curve forward section 115 that extends forwardly from the rearward section 114 to the forward end 104. The forward section 115 curves downwardly until the forward section 115 projects rearwardly. The forward end 104 has a barb shape, extending downwardly and rearwardly from the forward section 115 and then folding rearwardly to project upwardly. The forward end 104 is sized to snap into the receiving slot 84 of each fastening clip 65, providing semi-permanent mounting of the reverse-curve shield 68 and preventing the wind from dislodging the reverse-curve shield 68. The forward end 104 of the reverse-curve shield 68 is slidably mounted to and floats relative to the fastening clips 65.

The gutter 67 and shield 68 are snapped together along the joint 112 and the fastening clips 65 are hooked onto the joint 112, prior to lifting the system 63 up to the fascia 32. The plurality of fastening clips 65 are spaced along the joint 112, in similar manner to the spaced fastening clips 13 of system 10 shown in FIG. 2. The shield 68 is left open with the forward end 104 unattached. The system 63 is raised to the fascia 32, and the fastening clips 65 are slid along the joint 112 for centering and proper spacing. The fasteners 66 are preferably deck screws. The fasteners 66 are inserted into the fastener apertures 85 in the fastening clips 65, and driven through the back wall 106 of the back dam 102 and into the fascia 32, to secure the system 63 to the fascia 32. The forward end 104 of the shield 68 is then snapped into the receiving slot 84.

Figure 10:
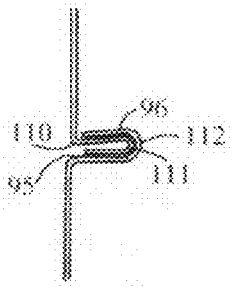
FIG. 10 is a side plan view of an alternative configuration of the joint of the system of FIG. 8.
Figure 11:
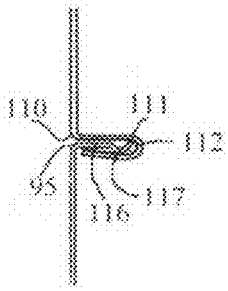
FIG. 11 is a side plan view of another alternative configuration of the joint of the system of FIG. 8.
Figure 12:
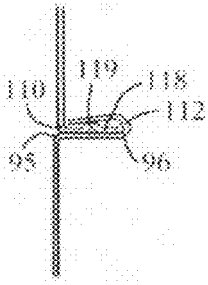
FIG. 12 is a side plan view of another alternative configuration of the joint of the system of FIG. 8.

FIG. 10 shows an alternative configuration of the joint 112 where the second crease 111 on the back dam 102 is sized and shaped to snap into the first crease 96 on the gutter 67. Referring to FIG. 11, in another alternative configuration of the joint 112, the first joint portion 95 is a first tab 116 with a downward bulge 117, sized to snap into the second crease 111 on the back dam 102. FIG. 12 shows another alternative configuration of the joint 112 where the second joint portion 110 is a second tab 111 with a upward bulge 119, sized to snap into the first crease 96 on the gutter 67.

Although the present invention has been described with a certain degree of particularity, it is understood that the present disclosure has been made by way of example and that changes in details of structure may be made without departing from the spirit thereof.

What is claimed is:

1. A covered rain gutter system mounting on a fascia below a roof of a building comprising:

a plurality of spaced fastening clips, a fastener for each fastening clip, said fasteners extending through said fastening clips to anchor said fastening clips to said fascia, an upwardly opening, trough shaped rain gutter having a back wall and a spaced front wall opposite said back wall, said back wall extending upwardly between said fastening clips and said fascia to an upper back end that terminates below said fasteners, said back wall laterally slidably mounting to said fastening clips, and said front wall laterally slidably mounting to said fastening clips, and a reverse-curve shield having an upwardly projecting back dam and a shield portion that extends forwardly over said gutter to a spaced forward end, said back dam extending between said fastening clips and said fascia to said back wall of said gutter, said forward end laterally slidably mounting to said fastening clips, whereby said rain gutter floats laterally relative to said fascia while being anchored vertically and in a fore and aft direction, and said back dam prevents leakage behind said gutter.

2. The system as set forth in claim 1 wherein:

said upper back end of said back wall of said rain gutter has a forwardly projecting first joint portion, and said back dam has a lower back end with a forwardly projecting second joint portion sized and shaped to snap together with said first joint portion to form a joint, whereby said joint prevents leakage between said gutter and said back dam.

3. The system as set forth in claim 2 wherein said first joint portion includes a rearwardly opening first crease and said second joint portion includes a rearwardly opening second crease that is sized to snap over said first crease.

4. The system as set forth in claim 1 including means for aligning said fastening clips along said back dam and said gutter.

5. The system as set forth in claim 4 wherein:

said fastening clips each have a base, said gutter and said back dam connect to each other along a snap together joint, and said means for aligning includes a rearwardly opening groove in said base of said fastening clips that is sized and shaped to receive said joint.

6. The system as set forth in claim 1 wherein said fastening clips each include an upwardly opening receiving slot sized and shaped to receive said forward end of said shield, said receiving slot being located to place said shield at a selected angle and at a selected alignment over said gutter, whereby said receiving slot laterally slidably mounts said forward end of said shield on said fastening clips.

7. The system as set forth in claim 6 wherein said receiving slot has a barb shape and said forward end of said shield has a barb shape sized to fit into said receiving slot, whereby said forward end of said shield snaps into said receiving slot to semi-permanently mount said shield to said fastening clips.

8. The system as set forth in claim 1 wherein said front wall of said rain gutter includes an upper front end, and said upper front end includes an upwardly and rearwardly angled front portion for improving debris shedding.

9. The system as set forth in claim 1 wherein said rain gutter is made of roll formed sheet metal.

10. The system as set forth in claim 1 wherein said shield is made of roll formed sheet metal.

11. A covered rain gutter system mounting on a fascia below a roof of a building comprising:

a plurality of spaced fastening clips each having a base and a support body extending forwardly from said base to a forward end, said base having a rearwardly opening groove, a fastener for each fastening clip, said fasteners extending through said fastening clips to anchor said fastening clips to said fascia, an upwardly opening, trough shaped rain gutter having a back wall and a spaced front wall opposite said back wall, said back wall extending upwardly between said fastening clips and said fascia to an upper back end that terminates below said fasteners, said back wall laterally slidably mounting to said fastening clips, and said front wall laterally slidably mounting to said fastening clips, said upper back end having a forwardly projecting first joint portion, and a reverse-curve shield having an upwardly projecting back dam and a shield portion that extends forwardly over said gutter to a spaced forward end, said back dam extending between said fastening clips and said fascia to said back wall of said gutter and having a lower back end with a forwardly projecting second joint portion sized and shaped to snap together with said first joint portion to form a joint, said joint being sized to fit into said groove in said fastening clips to align said fastening clips along said back dam and said gutter, said forward end laterally slidably mounting to said fastening clips, whereby said rain gutter floats laterally relative to said fascia while being anchored vertically and in a fore and aft direction, and said back dam prevents leakage behind said gutter.

* * * * *